US011885497B2

(12) United States Patent
Lao

(10) Patent No.: US 11,885,497 B2
(45) Date of Patent: Jan. 30, 2024

(54) FUEL NOZZLE WITH SLOT FOR COOLING

(71) Applicant: PRATT & WHITNEY CANADA CORP., Longueuil (CA)

(72) Inventor: Si-Man Amy Lao, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 135 days.

(21) Appl. No.: 16/516,351

(22) Filed: Jul. 19, 2019

(65) Prior Publication Data

US 2021/0018174 A1 Jan. 21, 2021

(51) Int. Cl.

| | |
|---|---|
| ***F23R 3/00*** | (2006.01) |
| ***F23R 3/28*** | (2006.01) |
| ***F23D 14/58*** | (2006.01) |
| *F23D 14/78* | (2006.01) |
| *F23R 3/14* | (2006.01) |

(52) U.S. Cl.

CPC ..... *F23R 3/283* (2013.01); *F23D 14/58* (2013.01); *F23D 14/78* (2013.01); *F23D 2214/00* (2013.01); *F23R 3/14* (2013.01)

(58) Field of Classification Search

CPC ..... F23D 14/58; F23D 14/78; F23D 2214/00; F23R 3/14; F23R 3/12; F23R 3/06; F23R 3/04; F23R 3/002; F23R 3/283

See application file for complete search history.

(56) References Cited

U.S. PATENT DOCUMENTS

| | | | | | |
|---|---|---|---|---|---|
| 3,134,229 | A * | 5/1964 | Johnson | F23R 3/045 | 60/749 |
| 3,498,055 | A * | 3/1970 | Faitani | F23R 3/14 | 60/776 |
| 4,418,543 | A * | 12/1983 | Faucher | F23D 11/38 | 239/404 |
| 4,584,834 | A * | 4/1986 | Koshoffer | F23R 3/04 | 60/737 |
| 4,870,818 | A * | 10/1989 | Suliga | F23R 3/283 | 60/740 |
| 5,307,637 | A * | 5/1994 | Stickles | F23R 3/002 | 60/756 |
| 5,419,115 | A * | 5/1995 | Butler | F23R 3/283 | 60/740 |

(Continued)

FOREIGN PATENT DOCUMENTS

FR 2993347 1/2014

*Primary Examiner* — Edwin Kang

(74) *Attorney, Agent, or Firm* — Norton Rose Fulbright Canada LLP

(57) ABSTRACT

A fuel nozzle assembly comprising an annular slot surrounding a fuel nozzle, the annular slot having gas passages for feeding a gas into the slot and against an opposing wall of the slot. A method of operating a gas turbine engine including directing a gas flow into and across the slot against an opposing wall of the slot to generate a circulating gas flow filling the slot, the gas flow passing into the slot through one or more gas outlets within the slot and thereafter said gas flow exiting the slot into the combustion chamber, the gas outlets spaced away from the closed end of the slot. A gas turbine engine comprising a slot formed in a fuel nozzle assembly, the slot having one or more gas passages extending through a wall of the slot and feeding a gas into the slot against a another wall of the slot.

18 Claims, 8 Drawing Sheets

(56) References Cited

U.S. PATENT DOCUMENTS

| | | | | |
|---|---|---|---|---|
| 5,463,864 | A * | 11/1995 | Butler | F23R 3/283 60/800 |
| 5,956,955 | A * | 9/1999 | Schmid | F23R 3/10 60/748 |
| 7,926,281 | B2 | 4/2011 | Commaret et al. | |
| 8,783,038 | B2 | 7/2014 | Horikawa et al. | |
| 10,156,189 | B2 | 12/2018 | Sze et al. | |
| 2008/0000234 | A1* | 1/2008 | Commaret | F23D 11/107 60/748 |
| 2009/0000303 | A1* | 1/2009 | Patel | F23R 3/002 29/890.03 |
| 2010/0089020 | A1* | 4/2010 | Barton | F23R 3/286 60/39.53 |
| 2011/0271682 | A1* | 11/2011 | Sandelis | F23C 7/004 60/737 |
| 2012/0227373 | A1* | 9/2012 | Bunel | F02C 7/266 60/39.827 |
| 2013/0206739 | A1* | 8/2013 | Reed | B23K 26/389 219/121.71 |
| 2015/0059349 | A1* | 3/2015 | Patel | F23R 3/002 60/772 |
| 2015/0292743 | A1* | 10/2015 | Mook | F23R 3/283 60/806 |
| 2015/0323184 | A1* | 11/2015 | Tangirala | B23P 15/04 60/754 |
| 2016/0084503 | A1 | 3/2016 | Hawie et al. | |
| 2016/0356222 | A1* | 12/2016 | Niggemeier | F01D 21/003 |
| 2016/0377294 | A1* | 12/2016 | Wadayama | F23R 3/343 60/737 |
| 2017/0074518 | A1* | 3/2017 | Lee | F23R 3/14 |
| 2017/0363290 | A1* | 12/2017 | Mery | F23R 3/28 |
| 2018/0031243 | A1* | 2/2018 | Kamoi | F23R 3/002 |

* cited by examiner

FUEL NOZZLE WITH SLOT FOR COOLING

TECHNICAL FIELD

The application related generally to gas turbine engines and, more particularly, to fuel nozzles used therein.

BACKGROUND OF THE ART

Fuel nozzles supplying fuel to a combustion chamber of a gas turbine engine operate in high temperature environments as combustion of a volume of fuel mixture can happen shortly after it is released into the chamber by the fuel nozzle. Although existing fuel nozzle assemblies were satisfactory to a certain degree, there always remains room for improvement, such as in managing the temperature of the components in the vicinity of the fuel nozzle.

SUMMARY

In one aspect, there is provided a fuel nozzle assembly comprising: a combustion chamber end configured to cooperate with a tip of a fuel nozzle; an annular slot between the combustion chamber end and the tip, the annular slot having a first wall extending generally coaxially with and spaced apart from a second peripheral wall of the fuel nozzle, the first and second walls extending from an open end facing the combustor to a closed end at an opposition end thereof; one or more gas passages extending through the first wall and having an outlet communicating with the slot, the outlet directed toward the second wall, the outlet located on the first wall spaced away from the closed end.

In another aspect, there is provided a method of operating a gas turbine engine, the method comprising: directing a gas flow into and across a slot against an opposing wall of the slot to generate a circulating gas flow filling the slot, the slot including a closed end and an open end, the open end adjacent to a fuel nozzle and exposed to a combustion chamber of the gas turbine engine, the gas flow passing into the slot through one or more gas outlets within the slot and thereafter said gas flow exiting the slot into the combustion chamber, the gas outlets spaced away from the closed end of the slot.

DESCRIPTION OF THE DRAWINGS

Reference is now made to the accompanying figures in which.

DETAILED DESCRIPTION

Figure 1:
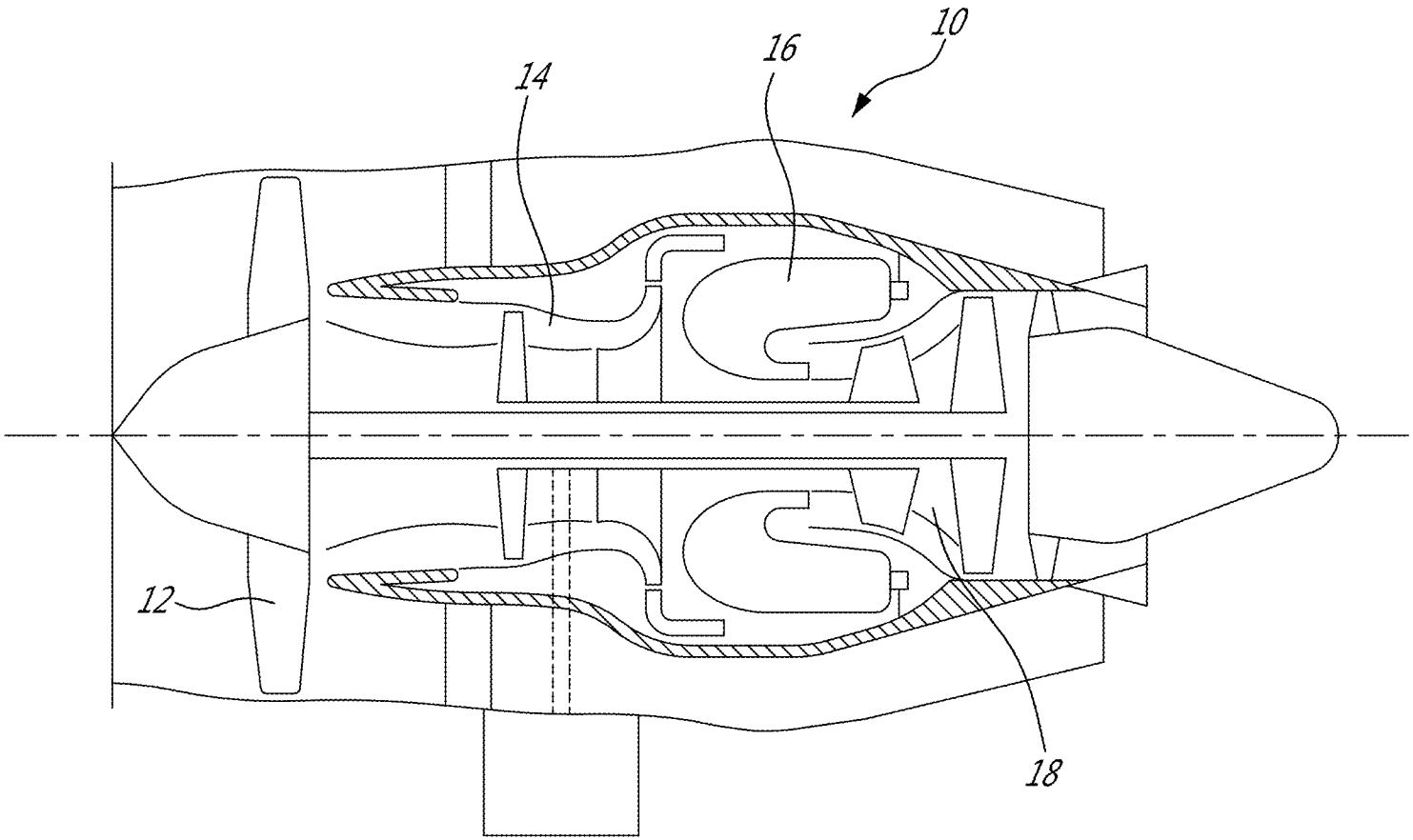
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The combustor 16 may include a combustion chamber outer casing 20 enclosing a combustion chamber liner 22. The combustor may be a reverse-flow combustor.

Figure 2:
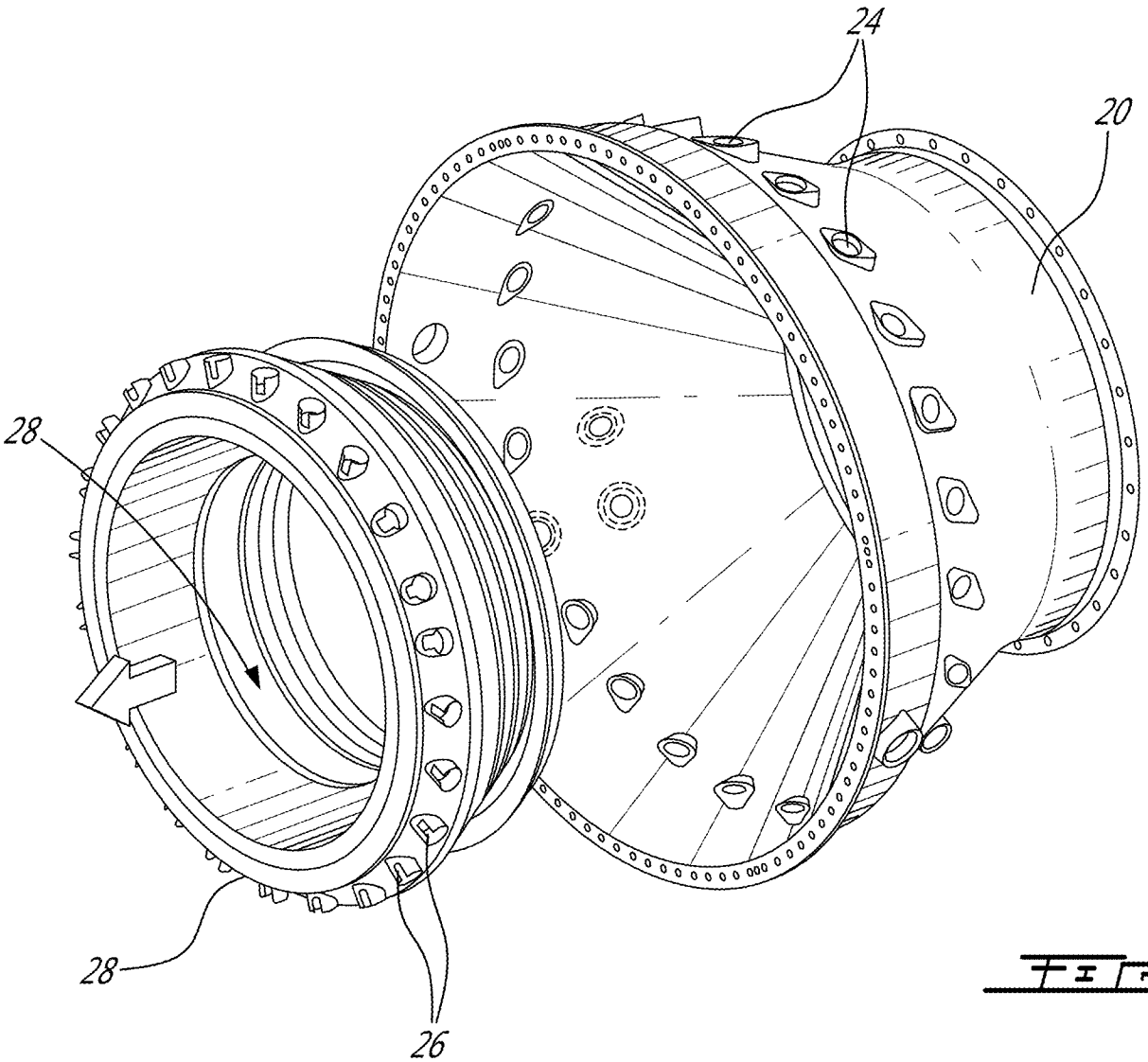
FIG. 2 is an exploded perspective view of an exemplary combustion chamber liner enclosed within an exemplary combustion chamber outer casing.

FIG. 2 is an exploded perspective view of an exemplary combustion chamber liner 22 enclosed within an exemplary combustion chamber outer casing 20. The combustion chamber liner and combustion chamber outer casing may form a portion of a straight-through combustor. The combustion chamber liner 22 may define a portion of the combustion chamber 28 suited to engine starting and sustained combustion. In some embodiments, a combustion chamber 28 may be defined by different components as would be apparent to one skilled in the art. In the present disclosure, a combustion chamber may refer to a space in the combustor wherein fuel is released for combustion, and a combustion chamber liner may refer to any structure that defines such a combustion chamber. The outer casing 20 may have a plurality of fuel nozzle ports 24 with complementary fuel nozzle ports 26 provided in the liner 22. Each pair of complementary fuel nozzle ports may be configured to cooperate with a fuel nozzle assembly. In some embodiments, a fuel nozzle assembly or a part thereof may be integral with the combustion chamber liner. A fuel nozzle, which may be slidingly received in the fuel nozzle assembly, may pass through a port in the outer casing 20 and then through a complementary port in the liner 22. In some of these embodiments, a fuel nozzle, when mounted on the liner 22 and outer casing 20, may fasten and/or support the liner 22 within the outer casing 20. Also meant to be included in the present description are any other structures or assemblies, apparent to one skilled in the art, which involve including a fuel nozzle in a combustion chamber liner to release fuel into a combustion chamber.

Figure 3:
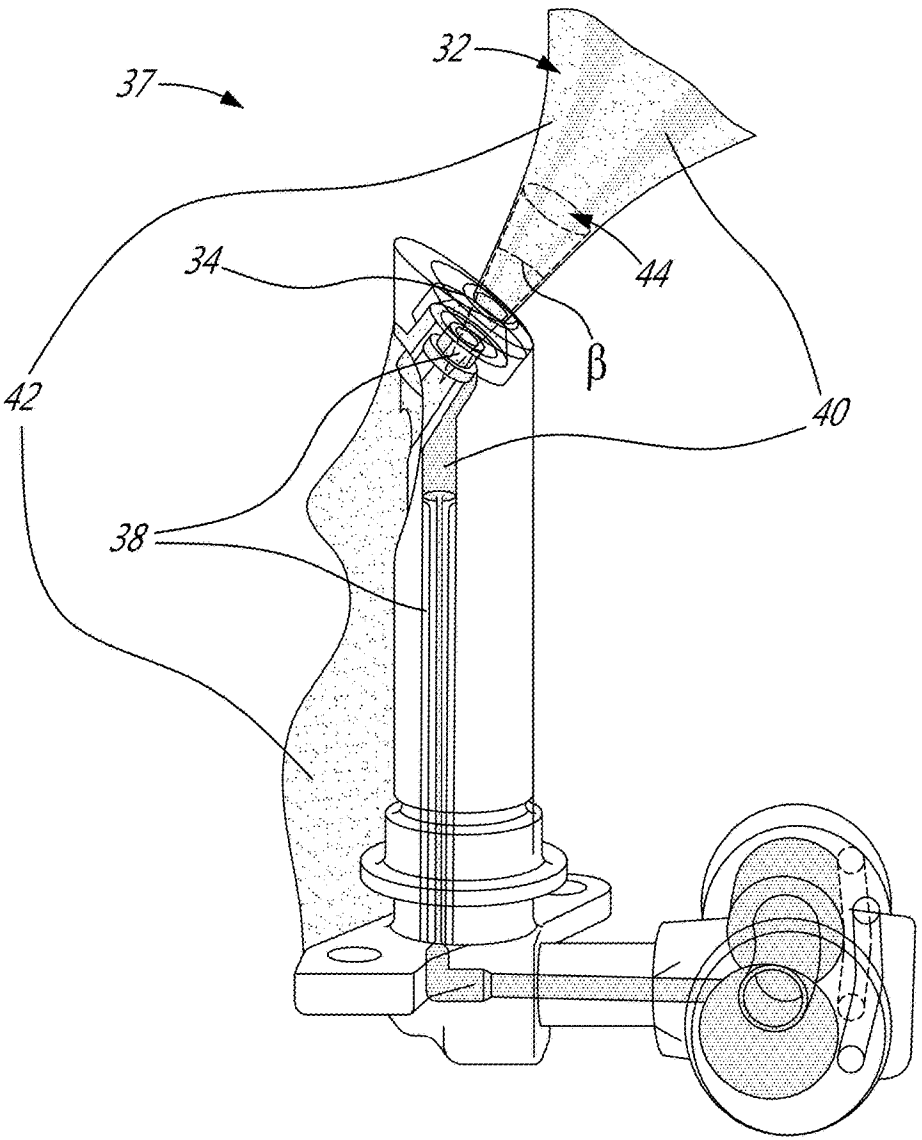
FIG. 3 is a perspective view of an exemplary fuel nozzle or stem with an exemplary fuel mixture flowing through a nozzle outlet.

FIG. 3 is a perspective view of an exemplary fuel nozzle or stem 37 with an exemplary fuel mixture 32 flowing through a nozzle outlet 34 in a fuel nozzle tip 35. Such a fuel nozzle 37 may be mountably received in a combustion chamber outer casing 20 and combustion chamber liner 22, as part of a fuel nozzle assembly. Other parts of such a fuel nozzle assembly may include a fuel nozzle collar 52. The fuel nozzle 37 may enclose a delivery path 38 for a fuel 40, gas 42 and/or a fuel mixture 32, the delivery path 38 path leading to a nozzle outlet 34. The nozzle outlet 34 may be configured to inject the fuel mixture 32 into the combustion chamber 28 defined by the liner 22. The fuel mixture may include one or more types of fuels 40 (in liquid or gas phase) and/or a gas 42, e.g. air from a compressor section 14 of the gas turbine engine 10. The fuel 40 and gas 42 may be mixed to form a single fuel mixture 32. In some embodiments, the fuel mixture 32 may exit the fuel nozzle 37 as a multiphase spray while in other embodiments the fuel mixture 32 may undergo atomization after leaving the fuel nozzle 37. The fuel mixture 32 may exit the fuel nozzle 37 through a portion of a conical volume 44 in space. The conical surface of the volume may form an angle β, with the central axis of the conical volume 44, and β, may be substantially 120° in some embodiments. In other embodiments, the fuel may exit through a narrower region: 0°<β<120° or through a wider region: 120°<β<180°. In such embodiments and others, the fuel may not fill an annular space 84 immediately adjacent to and around the fuel nozzle tip 35.

Figure 4:
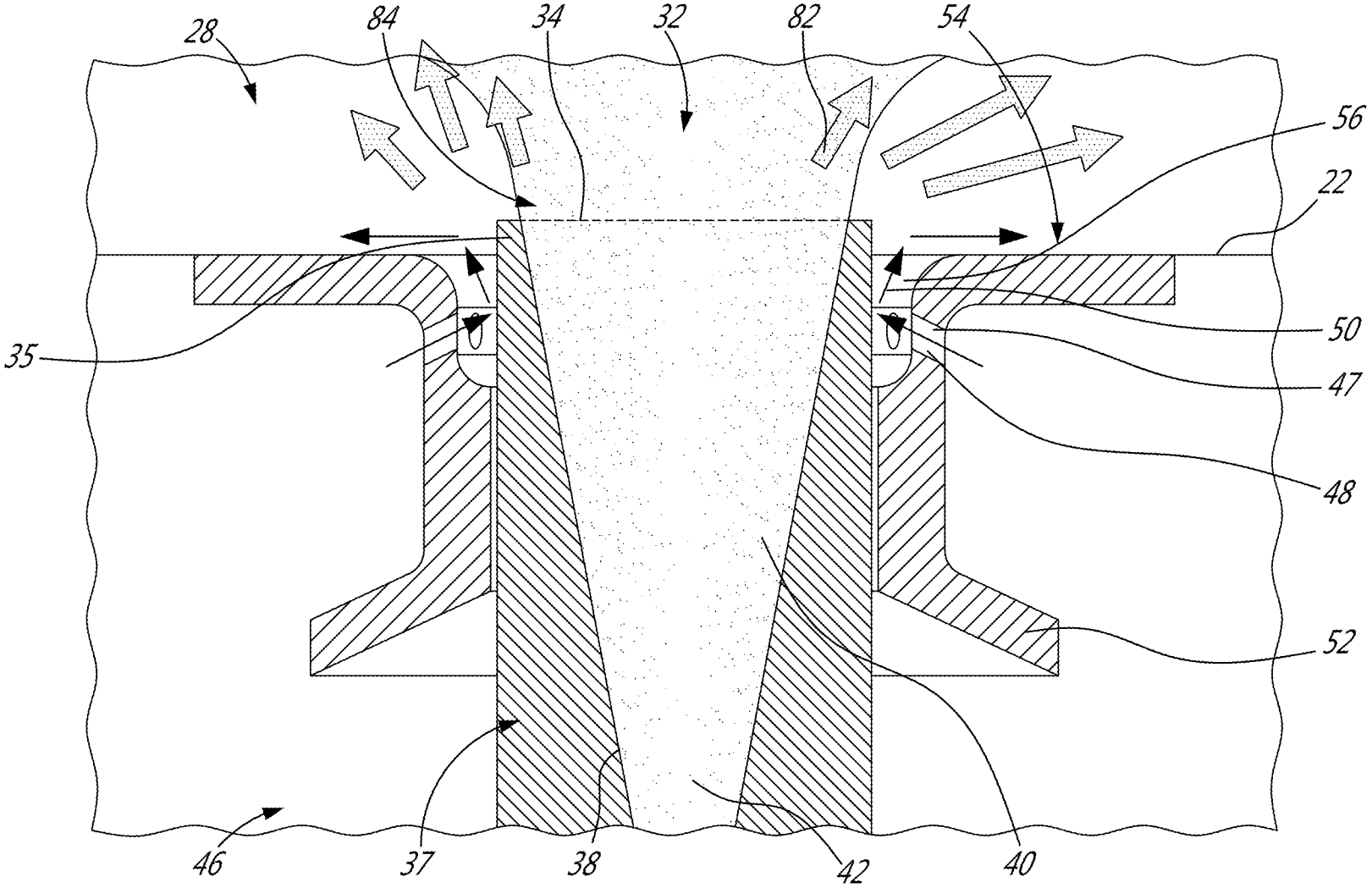
FIG. 4 is cross-sectional schematic view of an exemplary fuel nozzle assembly, the fuel nozzle assembly comprising a slot with gas passages for feeding a gas flow into the slot.

FIG. 4 is cross-sectional schematic view of an exemplary fuel nozzle assembly 46 mounted in a combustion chamber liner 22. The fuel nozzle assembly 46 may include a combustion chamber end 54, in this embodiment formed integrally with liner 22, having a nozzle tip 35 configured to be exposed to and facing the combustion chamber 28. The fuel nozzle assembly 46 may include a fuel nozzle or stem 37 for delivering a fuel/air mixture 32 to a combustion chamber 28, through the liner 22 and via a delivery path 38 defined in the fuel nozzle 37, the fuel nozzle 37 configured to inject the fuel mixture 32 through the nozzle outlet 34. As will be discussed in the context of FIG. 8 below, the combustion chamber end 54 may be provided as part of a collar arrangement integral to the liner 22, tip 35, or floatingly mounted between them.

An annular slot 56 may be formed in the combustion chamber end 54 of the fuel nozzle assembly 46, the slot 56 including an open end 58 facing the combustion chamber 28 and a closed end 60 distal from the said open end 58. The slot 56 may be adjacent to the nozzle tip 34. The slot 56 may be a substantially annular slot 56 around the fuel nozzle tip 35. The term "annular slot" is not intended to be restricted to slots with cross-sections (i.e. cross-sections substantially parallel to the open end of the slot) only having a circular annular shape, but also include those with cross-sections defining a continuous region between two concentric closed shapes, e.g. a large rectangle enclosing a smaller rectangle or circle. A wall 64 of the fuel nozzle 37 may form a wall internal to the slot 56.

The slot 56 may be formed by an annular collar 52 fitting around the fuel nozzle 37, i.e. a fuel nozzle collar 52 extending axially along the fuel nozzle 37 towards the fuel nozzle tip 35. In some embodiments, the collar 52 may be substantially free to have at least a limited motion in the axial direction along the fuel nozzle 37; such a fuel nozzle collar 52 may be specifically referred to as a floating fuel nozzle collar 52. A wall 62 of a fuel nozzle collar 52 may form a wall internal to the slot 56. Such a wall 62 may be a portion of a recess formed within an internal circumferential wall of the fuel nozzle collar 52. The slot 56 may be substantially composed of a cavity formed between the collar 52 recess and a wall 64 of the fuel nozzle 37, when the collar 52 is fitted over the fuel nozzle 37. The fuel nozzle 37 may be also be free to have at least a limited motion. Such a fuel nozzle may be specifically referred to as a floating fuel nozzle.

One or more slot corners defining the open end 58 of the slot 56 may be rounded corners, i.e. a substantially rounded corner may be formed at a junction between a slot wall 62 and a wall 70 of the combustion chamber end 54 of the fuel nozzle assembly 46. The wall 70 adjacent to the open end 58 of the slot 56 may be substantially flat. The wall 70 is be non-perpendicular to the open end 58 of the slot 56. The wall 70 may be distal from the fuel nozzle tip 35. The slot 56 may further include one or more gas passages, the gas passages 47 having outlets 48 opening into the slot 56 and configured to feed a gas flow 50 into the slot 56. Whenever gas passages and gas passage outlets are mentioned herein in the plural, the intention is to encompass both the singular and plural forms, unless otherwise indicated. The gas passages 47 may be channels formed in a slot wall 62. The channels may be formed in a wall 62 of a fuel nozzle collar 52. The channels may have a circular cross-section.

Figure 5:
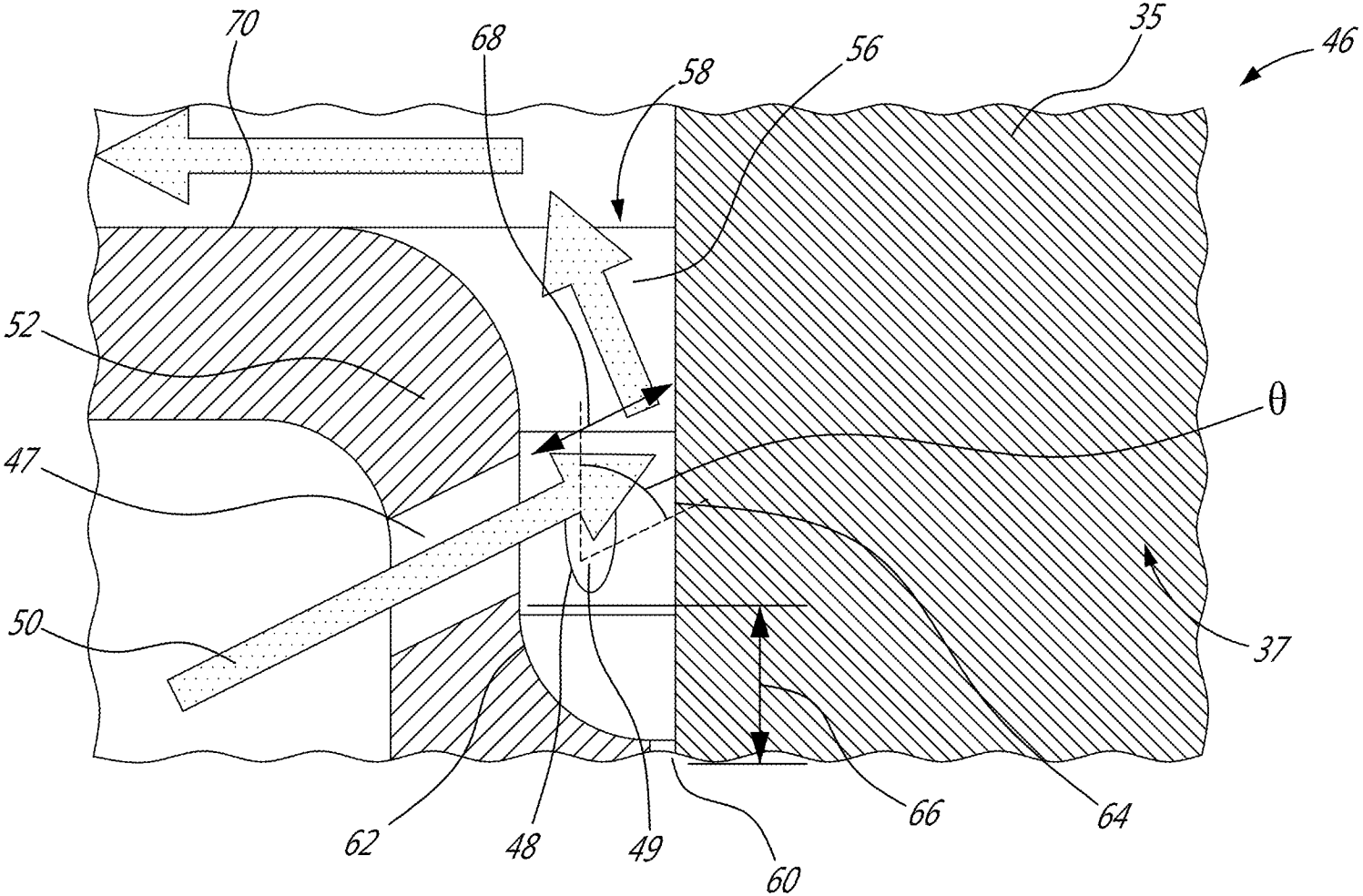
FIG. 5 is a close-up cross-sectional view of an exemplary fuel nozzle assembly.

FIG. 5 is a close-up cross-sectional view of an exemplary fuel nozzle assembly 46, focusing on the slot region. The gas passage outlets 48 in the slot 56 may be formed on a first wall 62, in this embodiment provided by the combustion chamber end 54, opposing and extending generally coaxially with and spaced apart from a second wall 64, in this example provided by a peripheral wall of the fuel nozzle tip 35. The first and second walls are configured to extend from the open end to the closed end of the slot 56. In some embodiments, the second wall may be provided by a peripheral wall of the fuel nozzle which is a wall adjacent to the fuel nozzle tip 35.

Figure 8:
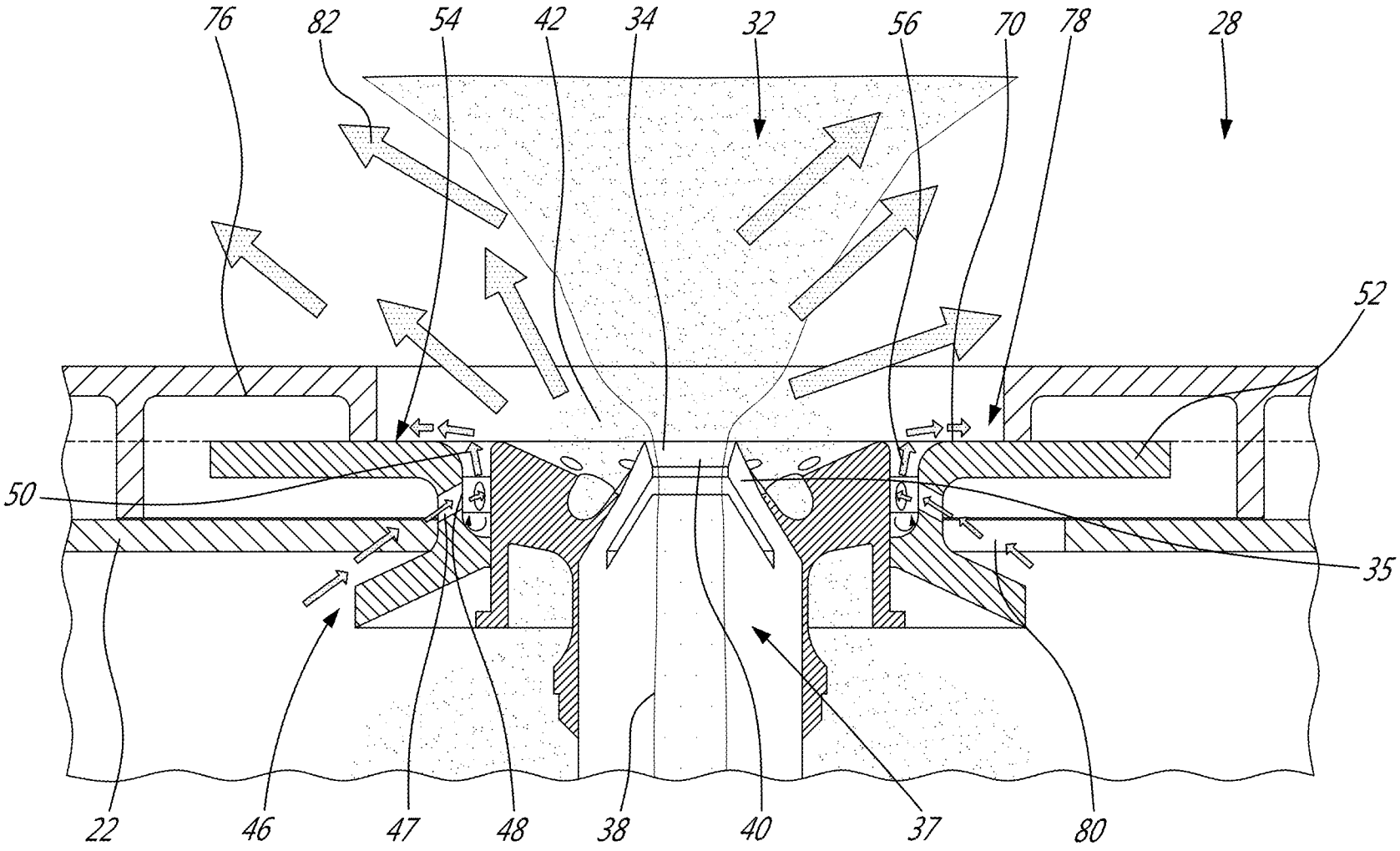
FIG. 8 is a cross-sectional schematic view of another embodiment of a fuel nozzle assembly.

The first wall 62 may be integral with the liner 22, or may be a fuel nozzle collar 52 wall provided integrally with or separately from the fuel nozzle tip 35. As shown in FIG. 8, the fuel nozzle collar 52 may be a floating collar. The second, opposing, wall 64 may be a peripheral wall of the fuel nozzle 37. The outlets 48 are configured to eject gas passing through them towards the opposing wall 64. The outlets 48 are spaced away from the closed end 60 of the slot 56 by a spacing distance 66. The spacing distance 66 may be chosen sufficiently large to allow gas flowing from the slot 56 to circulate on both sides of the slot 56. The gas passage 47 may have a sweep angle θ, the sweep being an angle formed between a central axis of the outlet 48 and a tangent to an opposing wall, e.g. the second wall 64 when the outlet 48 is on the first wall 62, wherein 0°≤θ≤45°. A swirl angle may also be present.

One or more of the outlets 48 may further include an aperture opening into the slot 56. The plurality of apertures 49 may be distributed along one of the walls 62, this distribution may be circumferential along an annular slot wall 62, the wall 62 may be more distant from a fuel nozzle tip 35 than the other slot wall 64, i.e. the wall 62 may form the outer circumference of the annular cross-section. Whenever apertures are mentioned herein in the plural, the intention is to encompass both singular and plural forms, unless otherwise indicated. The apertures 49 may be circular. The apertures 49 may have a diameter denoted $D_H$. The diameter $D_H$ may be substantially greater than a quarter of the width W, wherein W is the distance 68 between the outlet 48 and an opposing wall 64, e.g. W may be the distance between the first wall 62 and second wall 64. When the outlet 48 has a non-zero sweep angle θ, W may be the perpendicular distance between the first and second wall divided by sin θ. In various embodiments, $D_H$ may be substantially greater than ½ W, W, 1½ W, or 2 W.

The fuel nozzle assembly 46 may be manufactured, as would be apparent to one skilled in the art, so that the width W is such that impingement of a gas flow 50 exiting the outlet 48 onto the opposing wall 64 is encouraged, while heat transfer between the gas flow 50 and the opposing wall 64 is discouraged. For example, W may be sufficiently small to discourage turbulence because a turbulent gas flow increases heat transfer and the longer the distance a gas flow has to travel before impingement, the more likely it is to become turbulent. The ratio $A=W/D_H$ may determine the heat transfer efficiency of the gas flow 50. For higher A, there may be greater heat transfer between an impinging gas flow 50 and the opposing wall 64, whereas for lower A there may be lesser heat transfer between the two. In various embodiments, $D_H$ and W may be chosen so that A is less than 1, less than 2, less than 4, or less than 6. A plurality of apertures 49 may be formed in a slot wall so as to have a minimum distance between an aperture (the first aperture)

and another aperture (the second aperture) closest to the first aperture. This minimum distance may be between $D_H$ and 20 $D_H$. In some embodiments, the minimum distance may be between 2 $D_H$ and 15 $D_H$. In even other embodiments, the minimum distance may be between 5 $D_H$ and 10 $D_H$. The plurality of apertures 49 may be spaced and distributed equally so that the distance between any first aperture and a second aperture closest to the first aperture is substantially equal.

Figure 6:
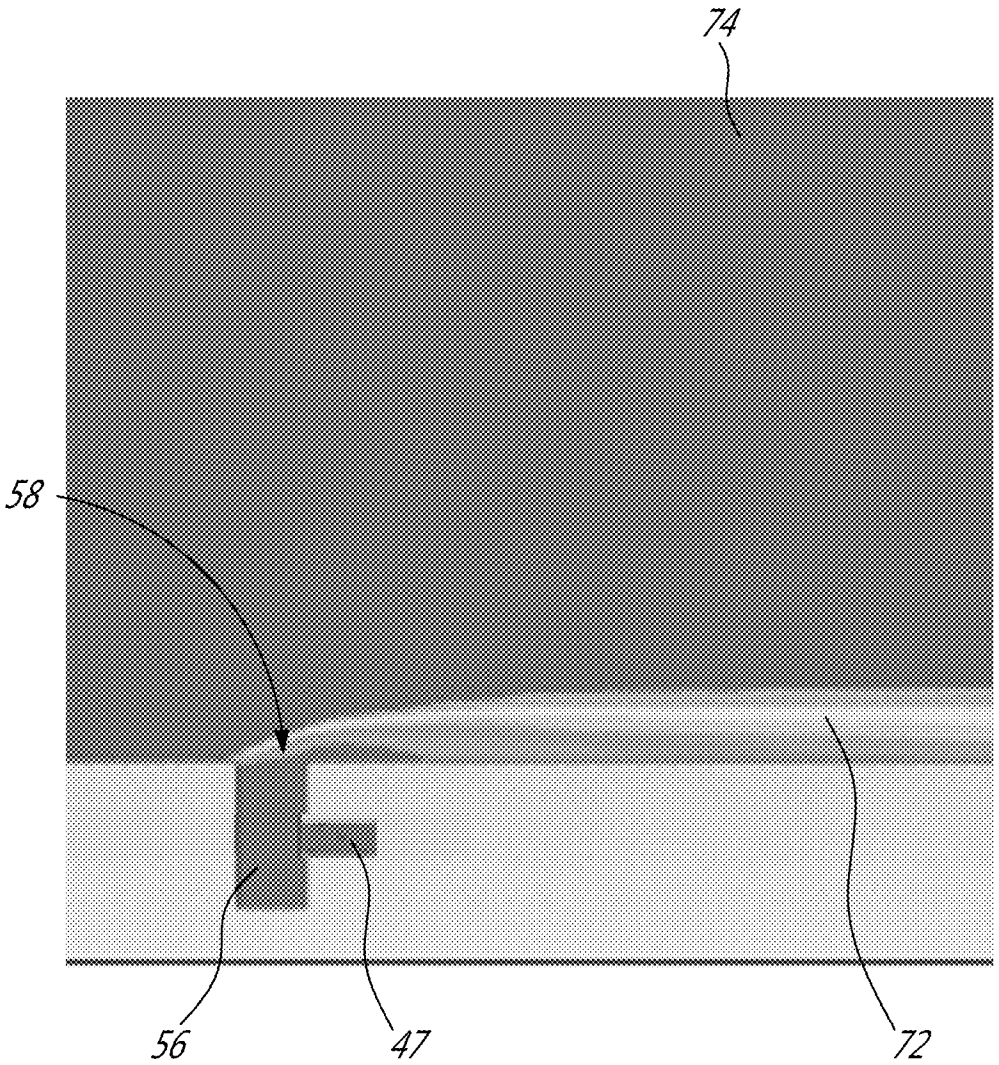
FIG. 6 is a cross-sectional view of an exemplary slot being fed by a gas passage, the figure showing isocontours of temperature.
Figure 7:
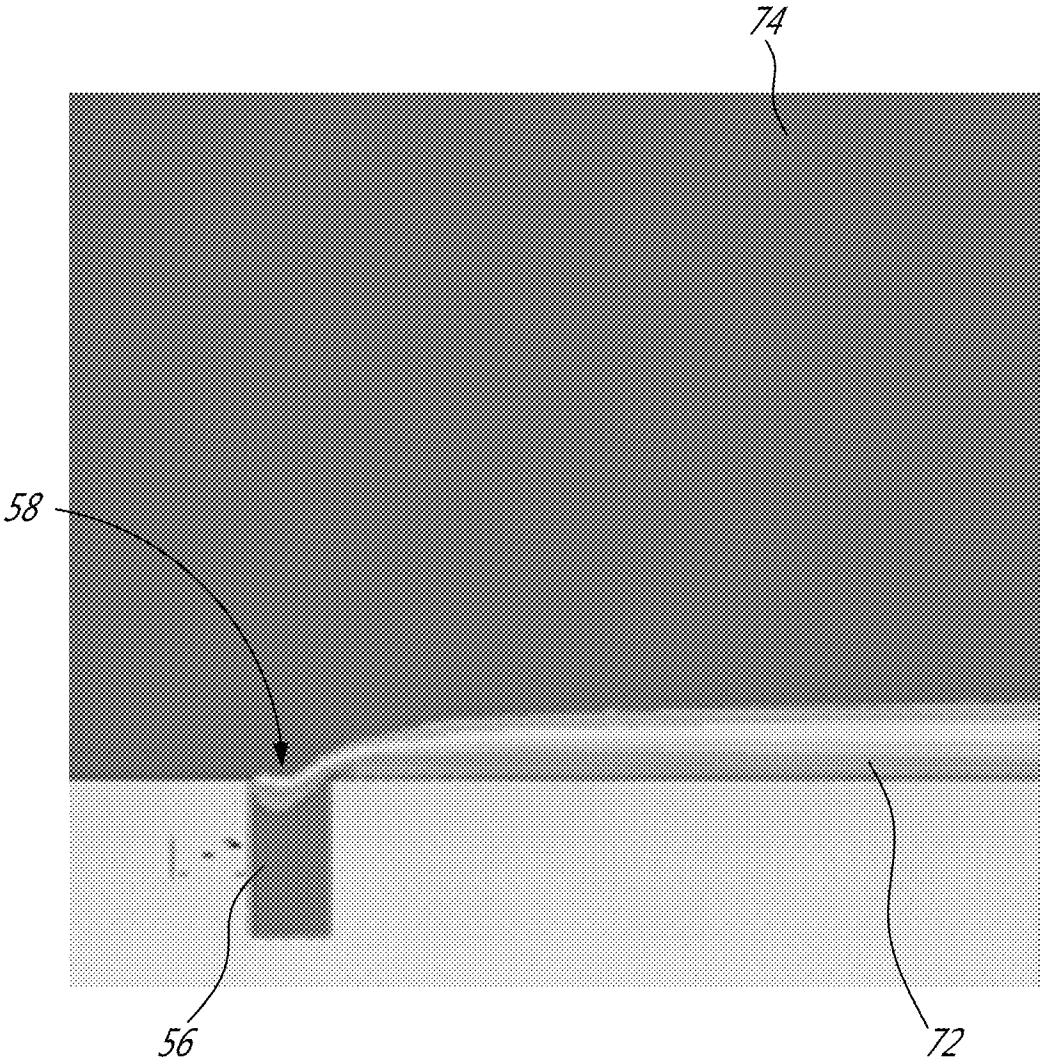
FIG. 7 is a cross-sectional view showing a portion of the slot of FIG. 6, the cross-section circumferentially removed from the gas passage outlet, the figure showing isocontours of temperature.

FIG. 6 is a cross-sectional view of an exemplary slot 56 being fed by a gas passage, the figure showing isocontours of temperature. The slot 56 is an annular and may be surrounding a fuel nozzle tip 34 and comprising at least one gas passage outlet 48, the outlets 48 oriented perpendicular to an opposing wall 64. The cross-sectional view is through a gas passage outlet 48, which is also seen in the figure. FIG. 7 is a cross-sectional view showing a portion of the slot 56 of FIG. 6, the cross-section circumferentially removed from the gas passage outlet 48, the figure showing isocontours of temperature. The temperature inside the slot 56 and around the gas passage outlet 48 is lower than the temperature in the far field 74 away from the slot 56 is hot. A gradient of temperature is formed at a wall 70 adjacent to the open end 58 of the slot 56, keeping away the relatively higher far field temperatures away from said wall 70. The temperature gradient initiates proximal to the open end 58 of the slot 56 and gradually forms nearly parallel isocontours of temperature over a portion of an adjacent wall 70.

FIG. 8 is a cross-sectional schematic view of another embodiment of a fuel nozzle assembly 46 including a floating fuel nozzle collar 52 and fuel nozzle 37, together fitting through a fuel nozzle port 80 formed in the combustion chamber liner 22. In some embodiments, the combustion chamber end 54 may be provided as part of a collar arrangement integral to the liner 22, or to the tip 35, or floatingly mounted between them. In various embodiments, the fuel nozzle collar 52 may be a floating collar or integral to the combustion chamber liner 22, or the fuel nozzle 37 a floating fuel nozzle or integral to the combustion chamber liner 22.

The fuel nozzle assembly 46 may include a fuel nozzle or stem 37 for delivering a fuel/air mixture 32 to a combustion chamber 28, through the liner 22 and via a delivery path 38 defined in the fuel nozzle 37, the fuel nozzle 37 configured to inject the fuel mixture 32 through the nozzle outlet 34. An annular slot 56 may be formed in the combustion chamber end 54 of the fuel nozzle assembly 46, the slot 56 including an open end 58 facing the combustion chamber 28 and a closed end 60 distal from the said open end 58. The slot 56 may be adjacent to the nozzle tip 35. The slot 56 may be a substantially annular slot 56 around the fuel nozzle tip 35. The term "annular slot" is not intended to be restricted to slots with cross-sections (i.e. cross-sections substantially parallel to the open end of the slot) only having a circular annular shape, but also include those with cross-sections defining a continuous region between two concentric closed shapes, e.g. a large rectangle enclosing a smaller rectangle or circle. A wall 64 of the fuel nozzle 37 may form a wall internal to the slot 56.

The slot 56 may be formed in an annular collar 52 fitting around the fuel nozzle 37, i.e. a fuel nozzle collar 52 extending axially along the fuel nozzle 37 towards the fuel nozzle tip 35. A wall 62 of a fuel nozzle collar 52 may form a wall internal to the slot 56. Such a wall 62 may be a portion of a recess formed within an internal circumferential wall of the fuel nozzle collar 52. The slot 56 may be substantially composed of a cavity formed between the collar 52 recess and a wall 64 of the fuel nozzle 37, when the collar 52 is fitted over the fuel nozzle 37.

One or more slot corners defining the open end 58 of the slot 56 may be rounded corners, i.e. a substantially rounded corner may be formed at a junction between a slot wall 62 and a wall 70 of the combustion chamber end 54 of the fuel nozzle assembly 46. The wall 70 adjacent to the open end 58 of the slot 56 may be substantially flat. The wall 70 may be non-perpendicular to the open end 58 of the slot 56. The wall 70 may be distal from the fuel nozzle tip 35. The slot 56 may further include one or more gas passages, the gas passages 47 having outlets 48 opening into the slot 56 and configured to feed a gas flow 50 into the slot 56. The gas passages 47 may be channels formed in a slot wall 62. The channels may be formed in a wall 62 of a fuel nozzle collar 52. The channels may have a circular cross-section.

The annular slot 56 may be recessed behind and abutting a heat shield 76, the heat shield 76 exposed to the combustion chamber 28. Spaced away from the open end 58 of the slot 56, the wall 70 may form a corner with a substantially non-parallel wall of the heat shield 76. The heat shield 76 may be integral to the liner 22 or may be a separate component attached to the liner 22. Apertures 49 in the slot 56 may be part of gas passage outlets 48 configured to feed a gas flow 50 into the slot 56. The apertures 49 may be substantially circular in diameter and may be chosen to encourage impingement of the gas flow 50 on an opposing wall 64, but discourage heat transfer, according to methods apparent to one skilled in the art and which have been described above in the discussion of FIG. 5.

Referring to FIG. 8, during operation of the gas turbine engine, a cooling air gas flow 50 exits the gas passage outlet 48 into the slot 56 to generate a flow at least partially filling the slot 56. The flow may be a circulating flow. The gas flow 50 may be a compressed or high-pressure gas and may be a gas from a compressor section of the gas turbine engine. The gas may be surrounding the combustion chamber liner 22 and may be entering the slot 56 through a channel providing flow communication with a region enveloping part of the liner 22. The circulating flow within the slot 56 may partially arise due to an impingement, upon an opposing wall 64, of the gas flow 50 exiting the gas passage outlet 48. The impingement may be such that high heat transfer may be avoided between the gas flow 50 and the opposing wall 64, e.g. by controlling geometry (such as by means of adjusting A as mentioned previously) of the slot 56 or the flow rate of the gas so that the turbulence intensity close to the opposing wall 64 is low. In embodiments wherein a floating fuel nozzle collar 52 forms a slot wall, the slot position may vary as the floating collar 52 moves axially along the fuel nozzle 37. A high pressure gas on one or more sides of the floating collar 52 may provide a force reducing or preventing movement of the floating collar 52. The high pressure gas may be in fluid communication with the gas flow 50 exiting the gas passage outlet 48 through the gas passages 47.

As gas flow continues to exit the gas passage outlet 48, another gas flow exits the slot 56 into the combustion chamber 28. The direction of the exiting gas flow may be non-parallel to an adjacent wall 70. A fuel mixture flow exiting the nozzle outlet 34 and a combustion chamber flow 82, which together may be of greater volume and may generally have higher momentum, may push the escaped gas flow towards a wall 70 adjacent to the open end 58 of the slot 56 to form a slab 72 of escaped gas flow extending over the wall 70, the wall 70 being substantially flat and non-perpendicular to the open end 58 of the slot 56. The gas flow may be radially extended over the wall, e.g. when the slot 56 is annular. The fuel mixture 32 may exit the nozzle outlet 34 through a conical volume 44 in space, the space delineating a region which is substantially not directly receiving fuel mixture 32 exiting the nozzle outlet 34. The slab 72 of escaped gas flow may penetrate this region.

The gas flow 50 exiting the gas passage outlet 48 may be of a lower temperature than a temperature of the combustion chamber 28, e.g. the far field temperature shown in FIGS. 6 and 7. A lower gas flow temperature may lead to lower temperatures in the region occupied by the slab 72 of escaped gas flow, as shown in FIGS. 6 and 7, thereby providing a cooling effect extending radially across the adjacent wall 70 and in the region between the far field 74 and the wall. The temperature of the gas flow 50 exiting the gas passage outlet 48 may be higher than the temperature of the fuel mixture 32 exiting the nozzle outlet 34. As a result, the slab 72 of exited gas flow may increase the temperature in a region closer to the nozzle outlet 34. Nevertheless, an overall temperature in a region around the fuel nozzle tip 35 may be lower due to the gas flow exiting the slot 56 and forming a slab 72 around the nozzle outlet 34. An overall temperature of the region may be an average temperature in the region or a highest temperature in the region, or any other representative temperature in the region.

Referring to the embodiment shown in FIG. 8, during operation of the gas turbine engine, high pressure gas behind the floating collar 52, proximal to the fuel nozzle port 80, may provide a force pushing the floating collar 52 against the heat shield 76. The high pressure gas may flow through apertures 49 in the slot 56, the gas circulating in and filling the slot 56 as described earlier. The high pressure may be a gas flowing through a fuel nozzle port 80 in the combustion chamber liner 22. The high pressure gas may also flow through the fuel nozzle 37 and exit through the nozzle outlet 34 as a constituent of the fuel mixture 32. Gas flow may exit the slot 56 through the open end 58 of the slot 56 and form a slab 72 on a wall 70 adjacent to the slot 56, as described earlier. The adjacent wall 70 may be the part of the fuel nozzle collar 52. The force may be a sealing force. The sealing force may reduce or stop flow of a gas between the combustion chamber 28 and one or more portions around the floating collar 52. The slab 72 may penetrate a region adjacent to a corner 78 formed between the adjacent wall 70 and a wall of the heat shield 76, thereby reducing the penetration of hot gas from the far field 74 into the same region.

The above description is meant to be exemplary only, and one skilled in the art will recognize that changes may be made to the embodiments described without departing from the scope of the invention disclosed. For example, in some embodiments the slot 56 may be formed without a fuel nozzle collar 52, e.g. a slot 56 maybe formed in the fuel nozzle 37 distal from the fuel nozzle tip 35, or the slot 56 may be formed in another separate component or using a part of another separate component. In some embodiments, the closed end 60 of the slot may have a portion with an opening. In some embodiments, the closed end 60 may include a portion providing a gas leakage into the slot. In some embodiments, a wall of the slot may include a heat shield or a portion of a heat shield. As referred to herein, a fuel nozzle assembly 46 need not be an assembly including a fuel nozzle 37. In such cases, the fuel nozzle assembly 46 may be complementary to a fuel nozzle 37 which may be separately configured to mount into the outer casing 20, liner 22, and/or any other relevant structure. For example, a fuel nozzle assembly 46 as referred to herein may not include a distinct fuel nozzle but instead may have a fuel nozzle collar 52 configured to be received in the liner 22 and to fit over a fuel nozzle provided separately. A fuel nozzle collar 52 may be integral to the liner. In some embodiments, a fuel nozzle assembly 46 may have only one integral component. In other embodiments, some outlets 48 may be formed on the first wall 62 while other outlets 48 may be formed on a second wall 64 of the slot 56. In some embodiments, gas passage outlets 48 may include non-circular apertures 49. In such embodiments, as referred to herein, a diameter of the aperture may be considered to be a length scale associated with the aperture, as may be calculated by one skilled in the art. For example, a hydraulic diameter $D_H$ may be considered a length scale. The hydraulic diameter $D_H$ of a two-dimensional area may be calculated according to a formula $D_H=4A_{CS}/P_{CS}$, where $A_{CS}$ denotes an area of the aperture and $P_{CS}$ denotes a perimeter of the aperture. The hydraulic diameter of a circular section is the same as the (standard) diameter. In some embodiments, the sweep angle of an outlet 48 may be greater than 45°, i.e. $45°<\theta<90°$. In various embodiments, the one or more of the gas passages 47 may be angled within a wall of the slot 56, or may be helically shaped in the streamwise direction, or may otherwise comprise curved or swirling channels, in order to swirl the gas flow 50 before it exits the gas passage outlet 48. In some embodiments, a swirling gas flow may be generated by guide vanes in the gas passages, the guide vanes guiding the flow so that it spirals towards the opposing surface, the spiralling being around an axis that is non-parallel to the opposing surface. In other embodiments, geometrical features such as wiggles, chamfers, fillets, rounds, grooves, or other features, both large and small, as may be apparent to one skilled in the art, may be added to the gas passages 47, outlets 48, apertures 49, collar 52, or any other part or portion of a part disclosed herein. Such geometrical features may be added for various reasons, including but not limited to improving manufacturability, reducing cost, reducing the heat transfer rate between gas flow 50 from the gas passages 47 and an opposing wall 64, increasing the circulation of fluid in the slot 56, reducing temperatures in the fuel nozzle region, increasing the thickness of the slab 72 of escaped gas, and reducing the temperature increase of the fuel mixture 32 due to the gas flow emanating from the slot 56. In various embodiments, the heat shield 76 may be integral to the combustion chamber liner 22, or may be integral to a portion of the internal surface of the combustion chamber liner 22 whereas the remaining portions may comprise mountable heat shields. The gas turbine engine may be a turbofan, a turbojet, a turbo shaft or any other gas turbine engine incorporating a combustion chamber with a fuel nozzle assembly 46. Still other modifications which fall within the scope of the present invention will be apparent to those skilled in the art, in light of a review of this disclosure, and such modifications are intended to fall within the appended claims.

The invention claimed is:

1. A fuel nozzle assembly comprising:

a fuel nozzle having a tip for outputting a flow of fuel in a combustion chamber via a nozzle outlet, the nozzle outlet open directly to the combustion chamber;

a collar extending around the fuel nozzle about a central axis of the fuel nozzle, the fuel nozzle secured to a liner of the combustion chamber via the collar;

an annular slot radially between a first wall defined by the collar and a second peripheral wall defined by the fuel nozzle relative to the central axis, the first wall and second peripheral wall extending from an open end of the annular slot facing a combustor to a closed end of the annular slot, a slot outlet of the annular slot open directly to the combustion chamber, the slot outlet distinct from the nozzle outlet;

one or more gas passages extending through the first wall, each of the one or more gas passages having an outlet communicating with the annular slot, the outlet of each of the one or more gas passages directed toward the second peripheral wall, the outlet of each of the one or more gas passages located on the first wall spaced away from the closed end, the outlet of each of the one or more gas passages defining an exit flow axis intersecting the second peripheral wall; and a third wall extending radially away from the central axis around the slot outlet, the third wall connecting the first wall at the slot outlet, the slot outlet at an axial position relative to the central axis, the third wall extending normally to the central axis at the axial position, the nozzle outlet being at the axial position or the fuel nozzle protruding from the axial position into the combustion chamber;

wherein a connection between the third wall and the first wall has a rounded corner, the rounded corner facing the open end and operable for directing fluid from the slot outlet along the third wall.

2. The fuel nozzle assembly of claim 1, wherein each outlet of the one or more gas passages includes an aperture opening into the annular slot, the apertures being distributed circumferentially around the first wall.

3. The fuel nozzle assembly of claim 1, wherein the one or more gas passages includes an aperture having a diameter $D_H$ which is between 50% of a distance between the first wall and second peripheral wall and 200% of the distance between the first wall and the second peripheral wall.

4. The fuel nozzle assembly of claim 3, wherein the diameter $D_H$ is between 80% of the distance between the first wall and second peripheral wall and 200% of the distance between the first wall and the second peripheral wall.

5. The fuel nozzle assembly of claim 4, wherein the diameter $D_H$ is between 100% of the distance between the first wall and second peripheral wall and 200% of the distance between the first wall and the second peripheral wall.

6. The fuel nozzle assembly of claim 1, wherein the one or more gas passages includes at least two apertures having a diameter $D_H$, wherein a distance between a first aperture and a second aperture closest to the first aperture is between $D_H$ and $20D_H$.

7. The fuel nozzle assembly of claim 1, wherein the fuel nozzle is slidingly received within an opening in the collar.

8. The fuel nozzle assembly of claim 1, wherein the outlet of each of the one or more gas passages has a sweep angle of less than 45° between a tangent to a surface of the second wall and a central axis of the outlet of each of the one or more gas passages.

9. The fuel nozzle assembly of claim 1, wherein the one or more gas passages includes an aperture having a diameter $D_H$, and wherein a quotient of a distance between the first wall and second peripheral wall and the diameter $D_H$ is less than 6.

10. The fuel nozzle assembly of claim 9, wherein the quotient of the distance between the first wall and second peripheral wall and the diameter $D_H$ is less than 4.

11. The fuel nozzle assembly of claim 10, wherein the quotient of the distance between the first wall and second peripheral wall and the diameter $D_H$ is less than 2.

12. The fuel nozzle assembly of claim 11, wherein the quotient of the distance between the first wall and second peripheral wall and the diameter $D_H$ is less than 1.

13. A gas turbine engine comprising:

a combustion chamber; a fuel nozzle having a tip for outputting a flow of fuel in the combustion chamber via a nozzle outlet;

a collar extending around the fuel nozzle about a central axis of the fuel nozzle, the fuel nozzle secured to a liner of the combustion chamber via the collar;

a slot radially between a first wall defined by the collar and a second peripheral wall defined by the fuel nozzle, the first wall and the second peripheral wall extending from an open end of the slot to a closed end of the slot, a slot outlet of the slot in fluid flow communication with the combustion chamber independently of the fuel nozzle, the slot outlet distinct from the nozzle outlet;

one or more gas passages extending through the first wall, each gas passage having an outlet into the slot, the outlet of each of the one or more gas passages defining an exit flow axis directed against and intersecting the second wall and spaced away from the closed end; and a third wall extending radially away from the central axis around the slot outlet, the third wall connecting the first wall at the slot outlet, the slot outlet at an axial position relative to the central axis, the third wall extending normally to the central axis at the axial position, the nozzle outlet being at the axial position or the fuel nozzle protruding from the axial position into the combustion chamber;

wherein the open end of the slot comprises at least one rounded corner formed at a junction between the first wall and the third wall, the at least one rounded corner operable for directing fluid from the slot outlet along the third wall.

14. The gas turbine engine of claim 13, wherein each outlet of the one or more gas passages includes an aperture opening into the slot, the apertures being distributed circumferentially around the first wall.

15. The gas turbine engine of claim 13, wherein the one or more gas passages includes an aperture having a diameter $D_H$ which is between 50% of a distance between the first wall and second peripheral wall and 200% of the distance between the first wall and the second peripheral wall.

16. The gas turbine engine of claim 13, wherein the one or more gas passages includes at least two apertures having a diameter $D_H$, wherein a distance between a first aperture and a second aperture closest to the first aperture is between $D_H$ and $20D_H$.

17. The gas turbine engine of claim 13, wherein the fuel nozzle is slidingly received within an opening in the collar.

18. The gas turbine engine of claim 13, wherein the outlet of each of the one or more gas passages has a sweep angle of less than 45° between a tangent to a surface of the second wall and a central axis of the outlet of each of the one or more gas passages.

* * * * *